US007628035B2

(12) United States Patent
Paradowski

(10) Patent No.: US 7,628,035 B2
(45) Date of Patent: Dec. 8, 2009

(54) METHOD FOR PROCESSING A STREAM OF LNG OBTAINED BY MEANS OF COOLING USING A FIRST REFRIGERATION CYCLE AND ASSOCIATED INSTALLATION

(75) Inventor: Henri Paradowski, Cergy (FR)

(73) Assignee: Technip France (FR)

( * ) Notice: Subject to any disclaimer, the term of this patent is extended or adjusted under 35 U.S.C. 154(b) by 488 days.

(21) Appl. No.: 11/539,828

(22) Filed: Oct. 9, 2006

(65) Prior Publication Data

US 2007/0095099 A1 May 3, 2007

(30) Foreign Application Priority Data

Oct. 10, 2005 (FR) ..... 05 10329

(51) Int. Cl.
*F25J 3/00* (2006.01)

(52) U.S. Cl. ..... 62/621; 62/623; 62/927

(58) Field of Classification Search ..... 62/620, 62/621, 623, 927
See application file for complete search history.

(56) References Cited

U.S. PATENT DOCUMENTS

| | | | | |
|---|---|---|---|---|
| 3,531,943 | A * | 10/1970 | Parnag et al. | 62/621 |
| 4,012,212 | A * | 3/1977 | Kniel | 62/621 |
| 4,225,329 | A * | 9/1980 | Bailey et al. | 62/623 |
| 4,592,767 | A * | 6/1986 | Pahade et al. | 62/623 |
| 4,662,919 | A * | 5/1987 | Davis | 62/622 |
| 5,421,165 | A * | 6/1995 | Paradowski et al. | 62/621 |
| 5,701,761 | A | 12/1997 | Prevost | |
| 6,308,531 | B1 | 10/2001 | Roberts | |
| 6,449,984 | B1 * | 9/2002 | Paradowski | 62/613 |
| 6,637,239 | B2 * | 10/2003 | Oakey | 62/620 |
| 6,898,949 | B2 * | 5/2005 | Paradowski | 62/613 |
| 6,978,638 | B2 * | 12/2005 | Brostow et al. | 62/623 |
| 2005/0056051 | A1 | 3/2005 | Roberts | |

FOREIGN PATENT DOCUMENTS

| | | |
|---|---|---|
| EP | 0 296 313 A | 12/1988 |
| FR | 1 441 864 A | 6/1966 |

OTHER PUBLICATIONS

Paradowski H. et al.: High Efficiency 6 MTPA LNG Train design via two different mixed refrigerant processes aiche national meeting, XX, XX Mar. 10, 2002, pp. 245-247, XP009052299.
Search Report FR 05010329 dated Jul. 5, 2006.

* cited by examiner

*Primary Examiner*—William C Doerrler
(74) *Attorney, Agent, or Firm*—Ostrolenk Faber LLP

(57) ABSTRACT

In this method, the LNG stream is cooled using a refrigerating fluid in a first heat-exchanger. The refrigerating fluid is subjected to a second semi-open refrigeration cycle which is independent of the first cycle. The method comprises a step for introducing the stream of sub-cooled LNG into a distillation column and a step for recovering a stream of gas at the top of the column.

The second refrigeration cycle comprises a step for forming a stream of refrigerating fluid from a portion of the top stream of gas, a step for compressing the stream of refrigerating fluid to a high pressure, then a step for expanding a portion of the stream of compressed refrigerating fluid in order to form a substantially liquid sub-cooling stream. The substantially liquid stream is evaporated in the first heat-exchanger.

23 Claims, 5 Drawing Sheets

METHOD FOR PROCESSING A STREAM OF LNG OBTAINED BY MEANS OF COOLING USING A FIRST REFRIGERATION CYCLE AND ASSOCIATED INSTALLATION

CROSS REFERENCE TO RELATED APPLICATIONS

This application claims the benefit of the filing date of French Patent Application No. 0510329, filed Oct. 10, 2005, the disclosure of which is hereby incorporated by reference.

BACKGROUND OF THE INVENTION

The present invention relates to a method for processing a stream of LNG obtained by means of cooling using a first refrigeration cycle, the method being of the type comprising the following steps:

(a) the stream of LNG which has been brought to a temperature of less than −100° C. is introduced into a first heat-exchanger;

(b) the stream of LNG is sub-cooled in the first heat-exchanger by means of heat-exchange with a refrigerating fluid in order to form a stream of sub-cooled LNG; and (c) the refrigerating fluid is subjected to a second semi-open refrigeration cycle which is independent of the first cycle.

U.S. Pat. No. 6,308,531 discloses a method of the above-mentioned type, in which a stream of natural gas is liquefied using a first refrigeration cycle which uses the condensation and evaporation of a mixture of hydrocarbons. The temperature of the gas obtained is approximately −100° C. Then, the LNG produced is sub-cooled to approximately −170° C. using a second refrigeration cycle of the type referred to as a semi-open "inverted Brayton cycle" comprising a stage compressor and a gas expansion turbine.

A method of this type is not entirely satisfactory. The maximum yield of the inverted Brayton cycle is limited to approximately 40%. Furthermore, the operation thereof in a semi-open cycle is difficult to implement.

SUMMARY OF THE INVENTION

An object of the invention is therefore to provide an independent method for processing a stream of LNG which has an improved yield and which can be readily implemented in units of different structures.

To this end, the invention relates to a processing method of the above-mentioned type, characterised in that the method comprises the following steps:

(d) the stream of sub-cooled LNG is expanded in a dynamic manner in an intermediate turbine, maintaining this stream substantially in the liquid state;

(e) the stream from the intermediate turbine is cooled and expanded and then introduced into a distillation column;

(f) a stream of denitrogenated LNG at the bottom of the column and a stream of gas at the top of the column are recovered; and (g) the top stream of gas is compressed in a stage compressor, and, at an intermediate pressure stage of the compressor, a first portion of the top stream of gas which is compressed at an intermediate pressure PI is extracted in order to form a stream of combustible gas;

and in that the second refrigeration cycle comprises the following steps:

(i) an initial stream of refrigerating fluid is formed from a second portion of the top stream of gas which has been compressed at the intermediate pressure PI;

(ii) the initial stream of refrigerating fluid is compressed to a high pressure PH which is greater than the intermediate pressure PI in order to form a compressed stream of refrigerating fluid;

(iii) the compressed stream of refrigerating fluid is cooled in a second heat-exchanger;

(iv) the compressed stream of refrigerating fluid from the second heat-exchanger is separated into a primary cooling stream and a sub-cooling stream of the LNG;

(v) the sub-cooling stream is cooled in a third heat-exchanger, then in the first heat-exchanger;

(vi) the sub-cooling stream from the first heat-exchanger is expanded to a low pressure which is lower than the intermediate pressure PI in order to form a substantially liquid sub-cooling stream of the LNG;

(vii) the substantially liquid sub-cooling stream is evaporated in the first heat-exchanger in order to form a reheated sub-cooling stream;

(viii) the main cooling stream is expanded substantially to the low pressure PB in a main turbine and the main cooling stream from the main turbine is mixed with the reheated sub-cooling stream in order to form a mixed stream;

(ix) the mixed stream is reheated successively in the third heat-exchanger, then in the second heat-exchanger in order to form a reheated mixed stream; and (x) the reheated mixed stream is introduced into the compressor at a low pressure stage located upstream of the intermediate pressure stage.

The method according to invention may comprise one or more of the following features, taken in isolation or according to any technically possible combination:

- the high pressure PH is between approximately 40 and 100 bar, preferably between approximately 50 and 80 bar, and in particular between approximately 60 and 75 bar;
- the low pressure PB is lower than approximately 20 bar;
- during step (vi), the sub-cooling stream from the first heat-exchanger is expanded in a dynamic manner in a liquid expansion turbine;
- during step (ii), the initial stream of refrigerating fluid is at least partially compressed in an auxiliary compressor which is coupled to the main turbine;
- during step (i), a stream of $C_2$ hydrocarbons is introduced into the compressor in order to form a portion of the initial stream of refrigerating fluid;
- during step (iii), the compressed stream of refrigerating fluid is brought into a heat-exchange relationship with a secondary refrigerating fluid which circulates in the second heat-exchanger, the secondary refrigerating fluid being subjected to a third refrigeration cycle in which it is compressed at the outlet of the second heat-exchanger, it is cooled and condensed at least partially, then expanded before it is evaporated in the second heat-exchanger;
- the secondary refrigerating fluid comprises propane and optionally ethane; and
- before the expansion of step (e), the stream from the intermediate turbine is mixed with a supplementary stream of natural gas cooled by means of heat-exchange with the top stream of gas in a fourth heat-exchanger; and the content in terms of $C_2^+$ of the top gas is such that the stream cooled by the second heat-exchanger is purely gaseous.

The invention also relates to an installation for processing a stream of LNG obtained by means of cooling using a first refrigeration cycle, the installation being of the type comprising:

means for sub-cooling the stream of LNG comprising a first heat-exchanger in order to bring the LNG stream into a heat-exchange relationship with a refrigerating fluid; and a second semi-open refrigeration cycle which is independent of the first cycle, characterised in that it comprises:

an intermediate turbine for dynamic expansion of the stream of sub-cooled LNG from the first heat-exchanger;

means for cooling and expanding the stream from the intermediate turbine;

a distillation column which is connected to the cooling and expansion means;

means for recovering a stream of denitrogenated LNG at the bottom of the column, and means for recovering a stream of gas at the top of the column, a stage compressor which is connected to the means for recovering the stream of gas at the top of the column; and means for extracting a first portion of the top stream of gas tapped at an intermediate pressure stage of the compressor in order to form a stream of combustible gas;

and in that the second refrigeration cycle comprises:

means for forming an initial stream of refrigerating fluid from a second portion of the top gas compressed to the intermediate pressure;

means for compressing the initial stream of refrigerating fluid to a high pressure which is greater than the intermediate pressure in order to form a compressed stream of refrigerating fluid;

a second heat-exchanger in order to cool the compressed stream of refrigerating fluid;

means for separating the compressed stream of refrigerating fluid from the second heat-exchanger into a main cooling stream and a sub-cooling stream of the LNG;

a third heat-exchanger for cooling the sub-cooling stream;

means for introducing the sub-cooling stream from the third heat-exchanger into the first heat-exchanger;

means for expanding the sub-cooling stream from the first heat-exchanger to a low pressure which is lower than the intermediate pressure in order to form a substantially liquid sub-cooling stream of the LNG;

means for circulating the substantially liquid sub-cooling stream in the first heat-exchanger in order to form a reheated sub-cooling stream;

a main turbine for expanding the main cooling stream to the low pressure;

means for mixing the cooling stream from the main turbine with the sub-cooling stream which has been reheated in order to form a mixed stream;

means for circulating the mixed stream successively in the third heat-exchanger then in the second heat-exchanger in order to form a reheated mixed stream;

means for introducing the reheated mixed stream in the compressor at a low pressure stage which is located upstream of the intermediate pressure stage.

The installation according to the invention may comprise one of more of the following features, taken in isolation or according to any technical combination possible:

the high pressure PH is between approximately 40 and 100 bar, preferably between approximately 50 and 80 bar and in particular between approximately 60 and 75 bar;

the low pressure PB is lower than approximately 20 bar;

the means for expanding the sub-cooling stream from the first heat-exchanger comprise a liquid expansion turbine;

the means for compressing the initial stream of refrigerating fluid comprise an auxiliary compressor which is coupled to the main turbine;

the second refrigeration cycle comprises means for introducing a stream of $C_2$ hydrocarbons into the compressor in order to form a portion of the initial stream of refrigerating fluid;

the second heat-exchanger comprises means for circulating a secondary refrigerating fluid, the installation comprising a third refrigeration cycle comprising secondary means for compressing the secondary refrigerating fluid from the third heat-exchanger, secondary means for cooling and expanding the secondary refrigerating fluid from the secondary compression means, and means for introducing the secondary refrigerating fluid from the secondary expansion means into the second heat-exchanger; and the secondary refrigerating fluid comprises propane and optionally ethane; and it comprises means for mixing the stream of sub-cooled LNG with a supplementary stream of natural gas, and a fourth heat-exchanger in order to bring the supplementary stream into a heat-exchange relationship with the top stream of gas.

BRIEF DESCRIPTION OF THE DRAWINGS

Embodiments of the invention will now be described with reference to the appended drawings, in which.

DESCRIPTION OF A PREFERRED EMBODIMENT

Figure 1:
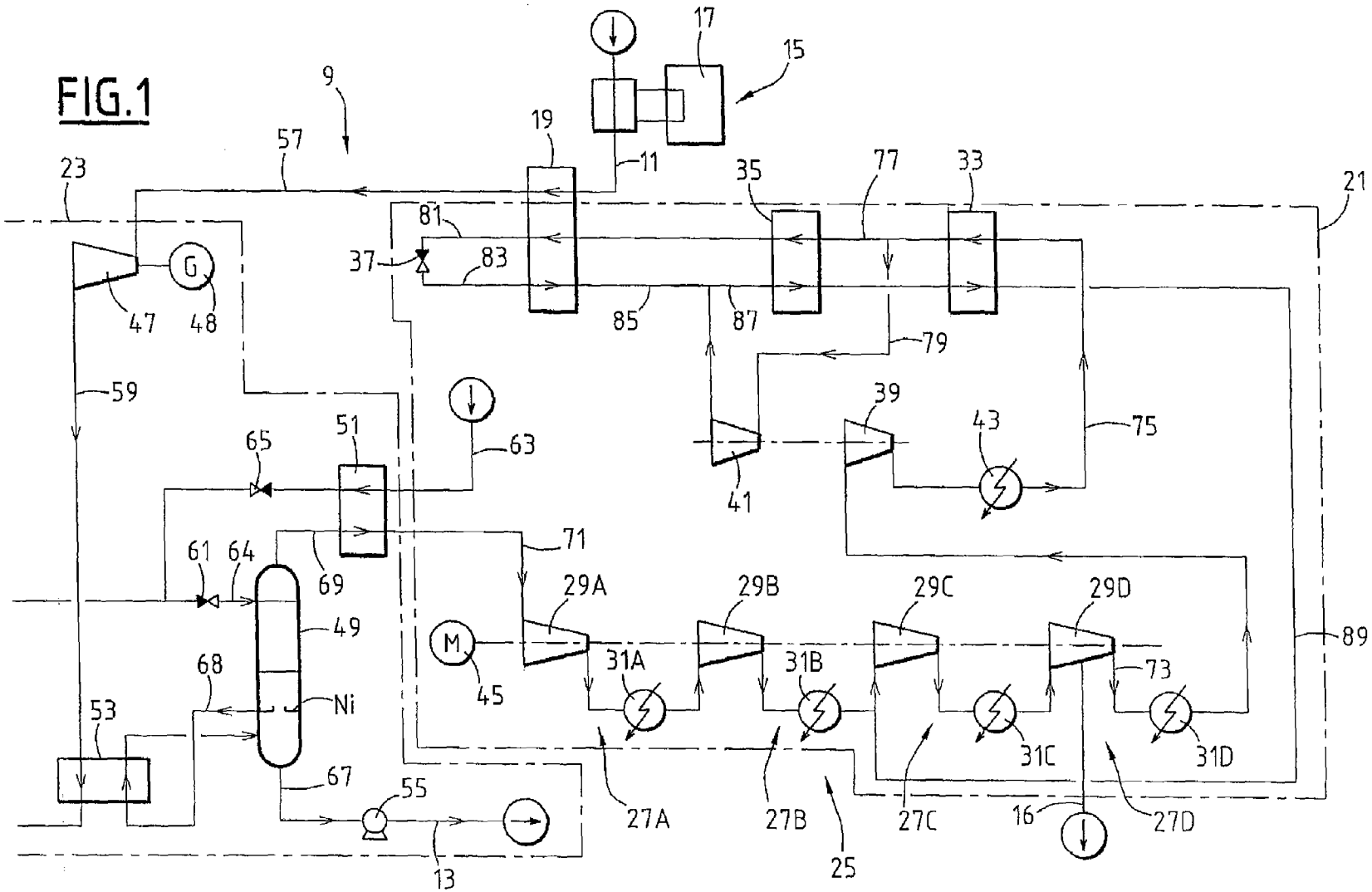
FIG. 1 is an operational block diagram of a first installation according to the invention.

The first sub-cooling installation 9 according to the invention, illustrated in FIG. 1, is intended to produce, from an initial stream 11 of liquefied natural gas (LNG) brought to a temperature of less than −90° C., a denitrogenated LNG stream 13. The installation 9 also produces a stream 16 of combustible gas which is rich in nitrogen.

As illustrated in FIG. 1, the initial stream 11 of LNG is produced by a unit 15 for liquefaction of natural gas comprising a first refrigeration cycle 17. The first cycle 17 comprises, for example, a cycle comprising means for condensation and evaporation of a mixture of hydrocarbons.

The installation 9 comprises a first sub-cooling heat-exchanger 19, a second semi-open refrigeration cycle 21 which is independent of the first cycle 17, and a denitrogenation unit 23.

The second refrigeration cycle 21 comprises a stage compression device 25 comprising a plurality of compression stages 27. Each stage 27 comprises a compressor 29 and a refrigeration unit 31.

The second cycle 21 further comprises a second heat-exchanger 33, a third heat-exchanger 35, a expansion valve 37 and an auxiliary compressor 39 which is coupled to a main expansion turbine 41. The second cycle 21 also comprises an auxiliary refrigeration unit 43.

In the example illustrated in FIG. 1, the stage compression device 25 comprises four compressors 29. The four compressors 29 are driven by the same external energy source 45. The source 45 is, for example, a motor of the gas turbine type.

The refrigeration units 31 and 43 are cooled by means of water and/or air.

The denitrogenation unit 23 comprises an intermediate hydraulic turbine 47 which is coupled to a stream generator 48, a distillation column 49, a heat-exchanger 51 for the top of the column and a heat-exchanger 53 for the bottom of the column. It further comprises a pump 55 for discharging denitrogenated LNG 13.

Below, a stream of liquid and the conduit which conveys it will be designated with the same reference numeral, the pressures in question are absolute pressures, and the percentages in question are molar percentages.

The initial LNG stream 11 from the liquefaction unit 15 is at a temperature lower than −90° C., for example, at −130° C. This stream 11 comprises, for example, approximately 5% of nitrogen, 90% of methane and 5% of ethane, and the flow rate thereof is 50,000 kmol/h.

The stream 11 of LNG is introduced into the first heat-exchanger 19, where it is sub-cooled to a temperature of −150° C. in order to produce a stream 57 of sub-cooled LNG.

The stream 57 is then introduced into the hydraulic turbine 47 and expanded in a dynamic manner to a low pressure in order to form a expanded stream 59. This stream 59 is substantially liquid, that is to say, it contains less than 2% mol of gas. The stream 59 is cooled in the bottom heat-exchanger 53, then introduced into a expansion valve 61 where it forms a stream 64 for supplying the column 49.

The stream 64 is introduced at the top of the distillation column 49, at a low distillation pressure. The low distillation pressure is slightly higher than atmospheric pressure. In this example, this pressure is 1.25 bar and the temperature of the stream 64 is approximately −165° C.

A supplementary stream 63 of natural gas, substantially of the same composition as the initial stream 11 of LNG, is cooled in the top exchanger 51 then expanded in a valve 65 and mixed with the stream 59 of expanded sub-cooled LNG upstream of the valve 61.

A reboiling stream 68 is extracted from the column 49 at an intermediate stage Ni, located in the region of the bottom of this column. The stream 68 is introduced into the exchanger 53, where it is reheated by means of heat-exchange with the stream 59 of expanded sub-cooled LNG, before being reintroduced into the column 49 below the intermediate level Ni.

A bottom liquid stream 67 containing less than 1% of nitrogen is extracted from the column 49. This bottom stream 67 is pumped by the pump 55 in order to form the stream 13 of denitrogenated LNG which is intended to be sent to a storage device.

A top gaseous stream 69 which contains almost 50% of nitrogen is extracted from the distillation column 49. This stream 69 is reheated by means of heat-exchange with the supplementary stream 63 in the top exchanger 51 in order to form a reheated top stream 71. This stream 71 is introduced into the first stage 27A of the compression device 25.

The reheated top stream 71 is successively compressed in the first stage 27A and in the second stage 27B of the compressor 25 substantially to a low cycle pressure PB, then compressed in the third compression stage 27C before being introduced into the fourth compression stage 27D. In each stage 27 of the compressor, the top stream 71 is subjected to a compression operation in the compressor 29 followed by cooling to a temperature of approximately 35° C. in the associated refrigeration unit 31.

A first portion 16 of the top stream compressed in the fourth compression stage 27D is extracted from the compressor 29D, at an intermediate pressure PI, in order to form the stream of combustible gas.

The intermediate pressure PI is, for example, greater than 20 bar and preferably substantially equal to 30 bar. The low cycle pressure PB is, for example, lower than 20 bar.

A second portion 73 of the top stream continues to be compressed in the compressor 29D to a mean pressure which is substantially equal to 50 bar in order to form an initial stream of refrigerating fluid.

The stream 73 is cooled in the exchanger 31D then introduced into the auxiliary compressor 39.

The flow rate of the initial stream 73 of refrigerating fluid is much higher than the flow rate of the stream 16 of combustible gas. The relationship between the two flow rates is, in this example, substantially equal to 6.5.

The stream 73 is then compressed in the compressor 39 to a high cycle pressure PH. This high pressure is between 40 and 100 bar, preferably between 50 and 80 bar and advantageously between 60 and 75 bar.

The stream 73 from the compressor 39 forms, after passing through the refrigeration unit 43, a stream 75 of compressed refrigerating fluid. The top stream 69 contains less than 5% by mass of $C_2^+$ hydrocarbons, so that the stream 75 is purely gaseous. When the high pressure is greater than approximately 60 bar, the stream 75 is a supercritical fluid.

The stream 75 is then cooled in the second heat-exchanger 33 and separated at the outlet of this exchanger 33 into a secondary sub-cooling stream 77 of the LNG and a primary main cooling stream 79. The relationship of these two flow rates is in the order of 0.5.

The sub-cooling stream 77 is cooled in the third exchanger 35, then in the first exchanger 19 in order to form a cooled sub-cooling stream 81. The stream 81 is expanded to the low cycle pressure PB in the valve 37 from where it is discharged in the form of a substantially liquid sub-cooling stream 83, that is to say, which contains less than 10% mol of gas.

The stream 83 is then introduced into the first exchanger 19, where it evaporates and cools, by means of heat-exchange, the stream 81 and the initial LNG stream 11, in order to form, at the outlet of the first exchanger 19, a reheated sub-cooling stream 85.

The gaseous main stream 79 is expanded in the turbine 41 substantially to the low cycle pressure PB and mixed with the reheated stream 85 from the first exchanger 19 in order to form a mixed stream 87. The mixed stream 87 is then introduced successively into the third exchanger 35, then into the second exchanger 33 where it cools, by means of a heat-exchange relationship, the sub-cooling stream 77 and the stream 75 of compressed refrigerating fluid.

The reheated mixed stream 89 from the exchanger 33 is then introduced into the compression device 25 at the inlet of the third compression stage 27C, substantially at the low pressure PB.

By way of illustration, the pressure, temperature, and flow rate values when the high cycle pressure PH is substantially equal to 75 bar are set out in the table below.

TABLE 1

| Stream | Temperature ° C. | Pressure (bar) | Flow rate (kmol/h) |
|---|---|---|---|
| 11 | −130.0 | 49.1 | 50000 |
| 13 | −161.1 | 5.3 | 46724 |
| 16 | 67.0 | 30.0 | 4876 |
| 57 | −150.0 | 49.0 | 50000 |
| 59 | −150.7 | 5.0 | 50000 |
| 63 | −34.0 | 50.0 | 1600 |
| 64 | −164.9 | 1.3 | 51600 |
| 67 | −161.1 | 1.2 | 46724 |
| 69 | −165.2 | 1.2 | 4876 |
| 71 | −48.6 | 1.2 | 4876 |
| 73 | 124.0 | 50.9 | 31768 |
| 75 | 35.0 | 74.7 | 31768 |
| 77 | −38.2 | 74.2 | 11496 |
| 79 | −38.2 | 74.2 | 20272 |
| 81 | −150.0 | 73.6 | 11496 |
| 83 | −155.2 | 11.0 | 11496 |
| 85 | −132.0 | 10.9 | 11496 |
| 87 | −130.3 | 10.9 | 31768 |
| 89 | 34.38 | 10.7 | 31768 |

Figure 2:
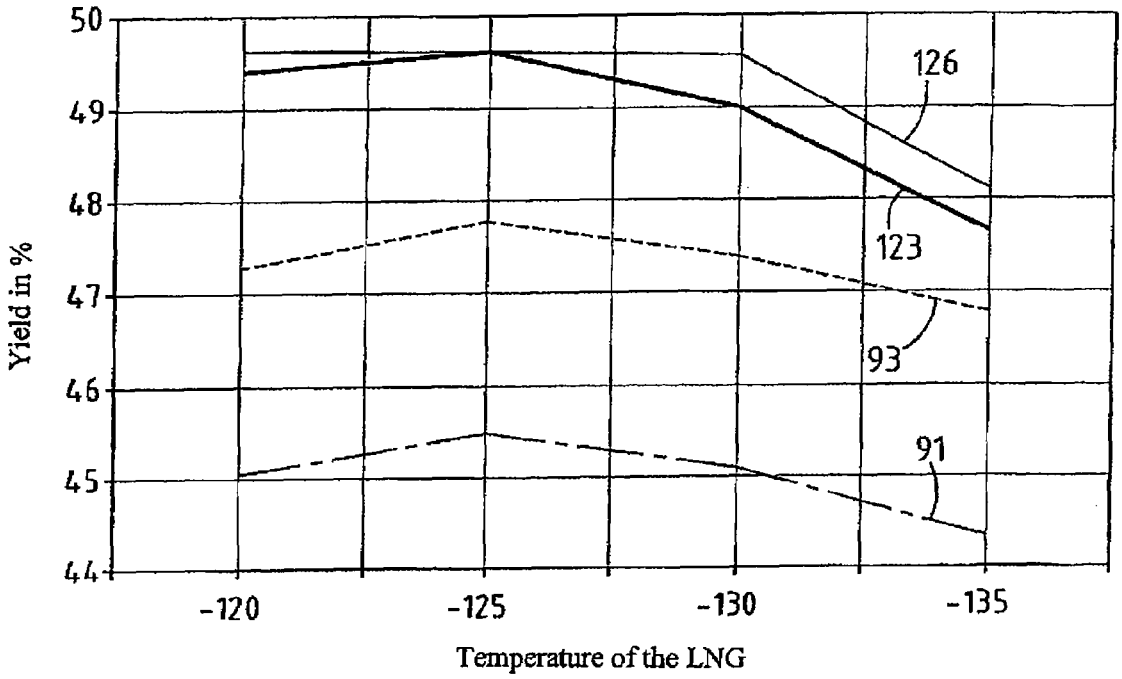
FIG. 2 is a graph which illustrates the efficiency lines of the second refrigeration cycle of the installation of FIG. 1, in accordance with the temperature of the LNG at the inlet of the first exchanger.

In FIG. 2, the efficiency line 91 of the cycle 21 in the method according to the invention is illustrated in accordance with the temperature value of the stream 11 of LNG. As illustrated in this Figure, the yields are greater than 44% which constitutes a significant increase compared with the methods of the prior art which involve a semi-open inverted Brayton cycle.

This result is obtained in a simple manner since it is not necessary to provide means for storing and preparing a refrigerating fluid, the refrigerating fluid 73 being continuously supplied by the installation 9.

The method and the installation 9 of the present invention are used either in new liquefaction units or to improve the efficiency levels of existing LNG production units. In the latter case, with equal power consumption, the production of denitrogenated LNG can be increased from 5% to 20%. The method and the installation 9 according to the invention can also be used to sub-cool and denitrogenate LNG produced in methods for extracting natural gas liquids (NGL).

Figure 3:
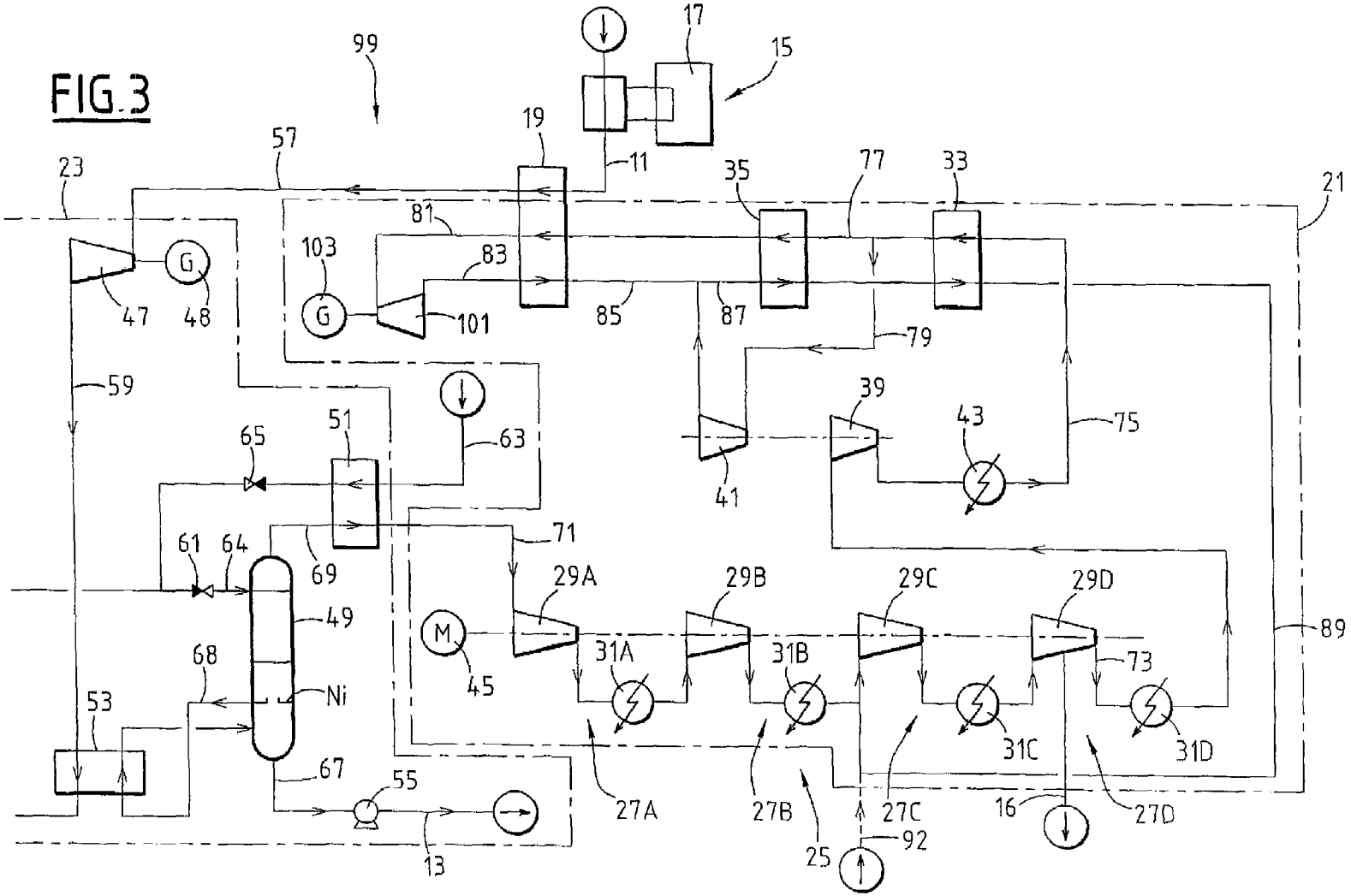
FIG. 3 is a diagram similar to that of FIG. 1 of a second installation according to the invention.

The installation 99 illustrated in FIG. 3 differs from the first installation 9 in that the expansion valve 37 located downstream of the first exchanger is replaced with a turbine 101 for dynamic expansion coupled to a stream generator 103.

The method for processing the stream of LNG in this installation is further identical to the method used in the installation 9, to within numerical values.

In a variant which is illustrated with a dot-dash line in FIG. 3, a stream 92 of ethane is mixed with the reheated mixed stream 89 before it is introduced into the third compression stage 27C.

The efficiency of the cycle 21 is then further increased as illustrated by the line 93 of FIG. 2.

Figure 4:
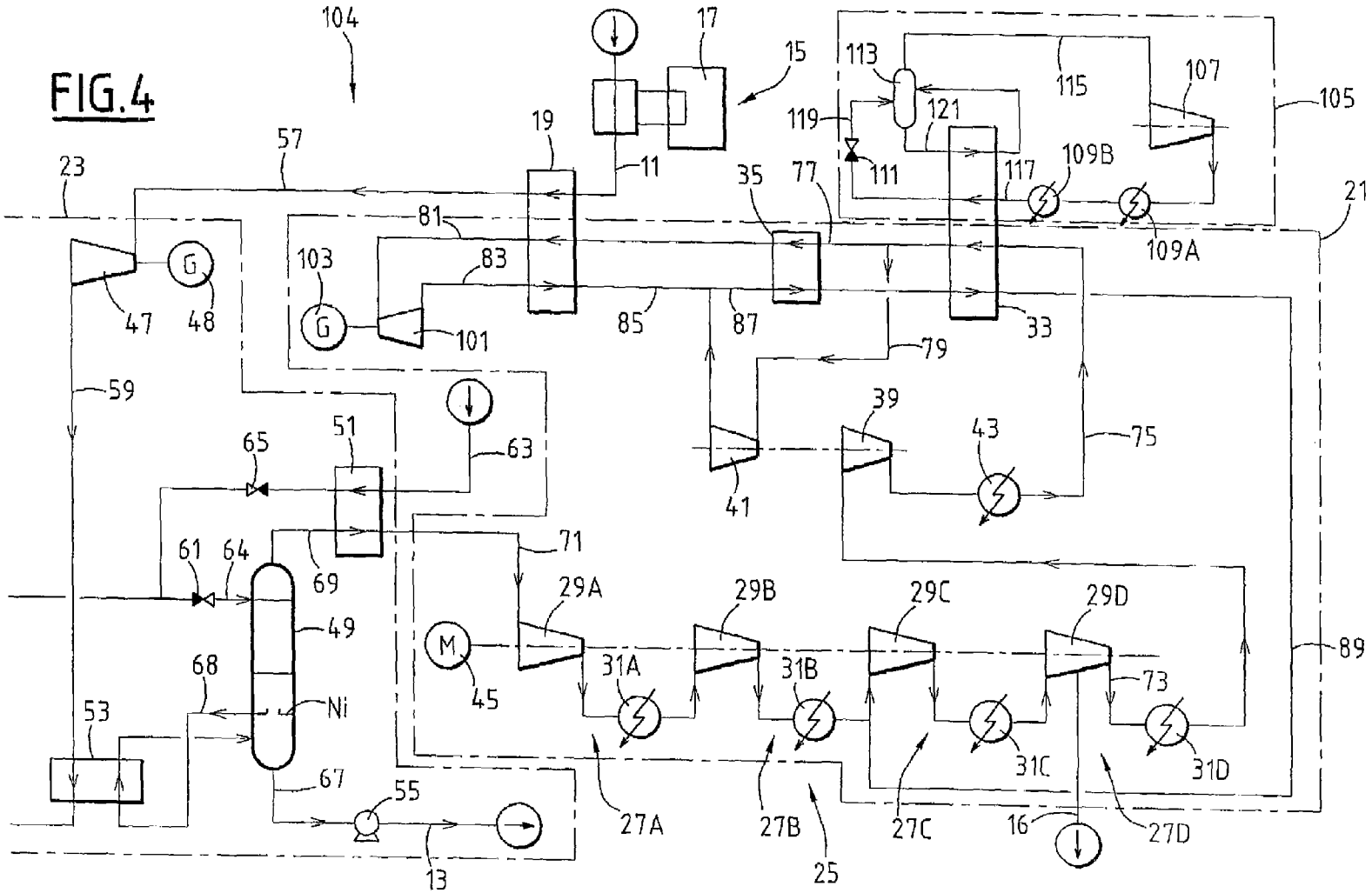
FIG. 4 is a diagram similar to that of FIG. 1 of a third installation according to the invention.

The third installation 104 according to the invention is illustrated in FIG. 4. This installation 104 differs from the second installation 99 in that it further comprises a third refrigeration cycle 105 which is closed and which is independent of the first and second cycles 17 and 21.

The third cycle 105 comprises a secondary compressor 107, first and second secondary refrigeration units 109A and 109B, a expansion valve 111 and a separating flask 113.

This cycle is implemented using a stream of secondary refrigerating fluid 115 which comprises propane. The gaseous stream 115 at the low pressure is introduced into the compressor 107, then cooled and condensed at the high pressure in the refrigeration units 109A and 109B in order to form a partially liquid stream 117 of propane. This stream 117 is cooled in the exchanger 33, then introduced into the expansion valve 111, where it is expanded and forms a biphase stream 119 of expanded propane.

The stream 119 is introduced into the separating flask 113 in order to form a liquid fraction 121 which is extracted from the bottom of the flask 113. The fraction 121 is introduced into the exchanger 33 where it is evaporated by means of heat-exchange with the stream 117 and with the stream 75 of compressed refrigerating fluid, before being introduced into the flask 113.

The gaseous fraction from the top of the flask 113 forms the stream 115 of gaseous propane.

As illustrated by the line 123 of FIG. 2, the efficiency of the cycle 21 is then increased by 4% on average compared with the efficiency of the method implemented in the first installation 9.

Figure 5:
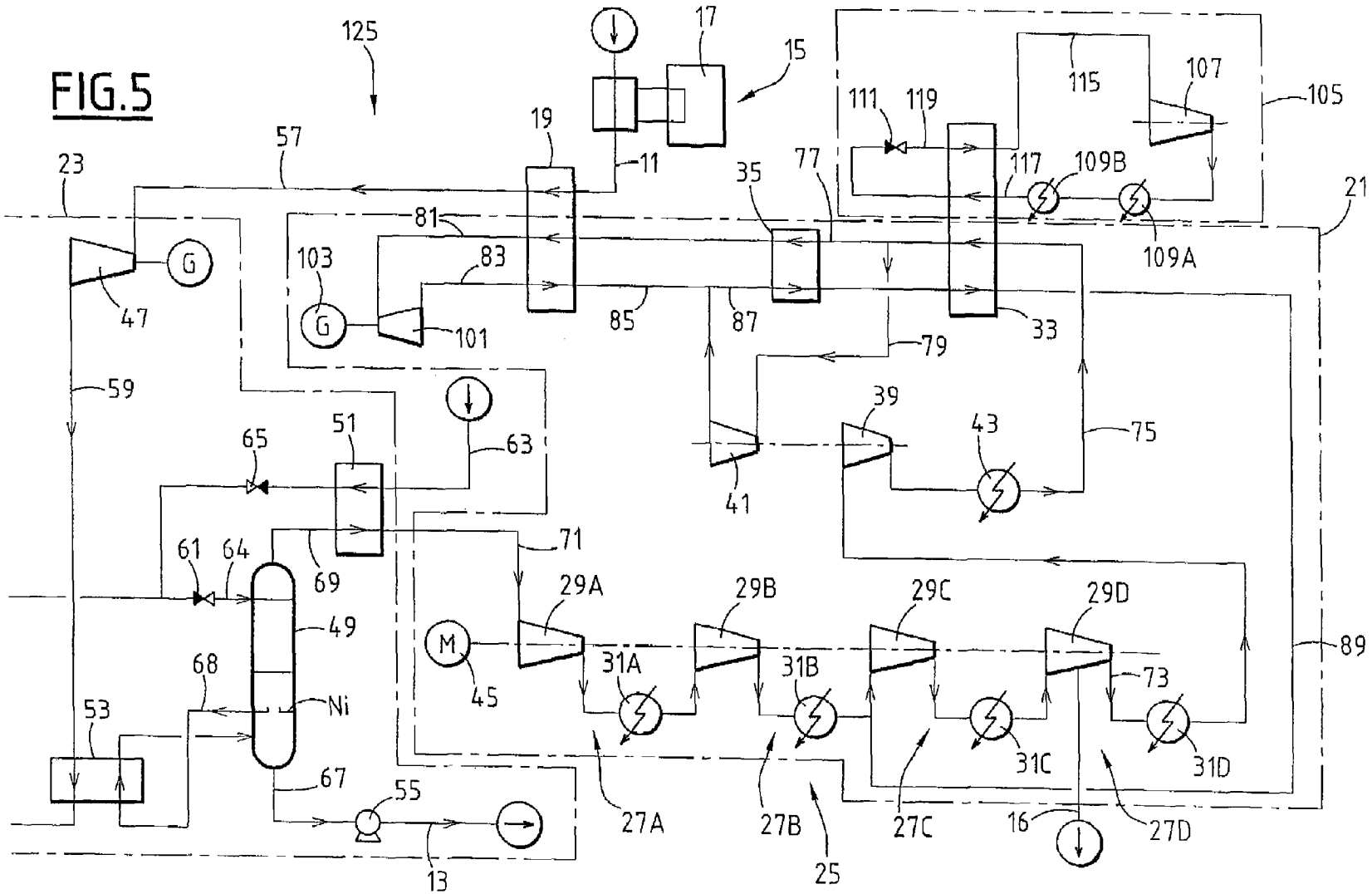
FIG. 5 is a diagram similar to that of FIG. 1 of a fourth installation according to the invention.

The fourth installation 25 according to the invention 125 illustrated in FIG. 5 differs from that illustrated in FIG. 4 in that the third refrigeration cycle 105 has no separating flask 113. The stream 119 from the valve 111 is therefore introduced directly into the second exchanger 33 and completely evaporated in this exchanger.

Furthermore, the refrigerating fluid 115 comprises a mixture of ethane and propane. The content in terms of ethane in the fluid 115 is substantially equal to the content in terms of propane.

As illustrated by the line 126 of FIG. 2, the mean efficiency of the second refrigeration cycle is then increased by approximately 0.5% compared with the efficiency of the method implemented in the third installation 104 when the temperature is lower than −130° C. Taking into account the energy produced by the turbine 47, the overall yield of the installation of FIG. 5 is slightly greater than 50%, compared with approximately 47.5% for that of FIG. 1, 47.6% for that of FIG. 3 and 49.6% for that of FIG. 4.

The invention claimed is:

1. Method for processing a stream of LNG obtained by means of cooling using a first refrigeration cycle, the method comprising the following steps:

(a) the stream of LNG which has been brought to a temperature of less than −100° C. is introduced into a first heat-exchanger;

(b) the stream of LNG is sub-cooled in the first heat-exchanger by means of heat-exchange with a refrigerating fluid in order to form a first stream of sub-cooled LNG; and (c) the refrigerating fluid is subjected to a second semi-open refrigeration cycle which is independent of the first cycle, (d) the first stream of sub-cooled LNG is expanded in a dynamic manner in an intermediate turbine, maintaining the first stream of sub-cooled LNG substantially in the liquid state;

(e) the first stream of sub-cooled LNG from the intermediate turbine is cooled and expanded and then introduced into a distillation column;

(f) a stream of denitrogenated LNG at the bottom of the column and a stream of gas at the top of the column are recovered; and (g) the top stream of gas is compressed in a stage compressor, and, at an intermediate pressure stage of the compressor, a first portion of the top stream of gas, which is brought to an intermediate pressure PI, is extracted in order to form a stream of combustible gas;

performing a second refrigeration cycle comprising the following steps:

(i) an initial stream of refrigerating fluid is formed from a second portion of the top stream of gas which has been compressed at the intermediate pressure PI;

(ii) the initial stream of refrigerating fluid is compressed to a high pressure PH which is greater than the intermediate pressure PI in order to form a stream of compressed refrigerating fluid;

(iii) the stream of compressed refrigerating fluid is cooled in a second heat-exchanger;

(iv) the stream of compressed refrigerating fluid from the second heat-exchanger is separated into a main cooling stream and a second sub-cooling stream of the LNG;

(v) the second sub-cooling stream is cooled in a third heat-exchanger, then in the first heat-exchanger;

(vi) the first sub-cooling stream of LNG from the first heat-exchanger is expanded to a low pressure PB which is lower than the intermediate pressure PI in order to form a substantially liquid sub-cooling stream of the LNG;

(vii) the substantially liquid sub-cooling stream is evaporated in the first heat-exchanger in order to form a reheated sub-cooling stream;

(viii) the main cooling stream is expanded substantially to the low pressure PB in a main turbine and a cooling stream from the main turbine is mixed with the reheated sub-cooling stream in order to form a mixed stream;

(ix) the mixed stream is reheated successively in the third heat-exchanger, then in the second heat-exchanger in order to form a reheated mixed stream; and (x) the reheated mixed stream is introduced into the compressor at a low pressure stage located upstream of the intermediate pressure stage.

2. Method according to claim 1, wherein the high pressure PH is between approximately 40 and 100 bar.

3. Method according to claim 1, wherein the low pressure PB is lower than approximately 20 bar.

4. Method according to claim 1, wherein during step (vi), the sub-cooling stream from the first heat-exchanger is expanded in a dynamic manner in a liquid expansion turbine.

5. Method according to claim 1, wherein during step (ii), the initial stream of refrigerating fluid is at least partially compressed in an auxiliary compressor which is coupled to the main turbine.

6. Method according to claim 1, wherein during step (i), a stream of C2 hydrocarbons is introduced into the compressor in order to form a portion of the initial stream of refrigerating fluid.

7. Method according to claim 1, wherein during step (iii), the compressed stream of refrigerating fluid is brought into a heat-exchange relationship with a secondary refrigerating fluid which circulates in the second heat-exchanger, the secondary refrigerating fluid being subjected to a third refrigeration cycle in which it is compressed at the outlet of the second heat-exchanger, it is cooled and condensed at least partially, then expanded before it is evaporated in the second heat-exchanger.

8. Method according to claim 7, wherein the secondary refrigerating fluid comprises propane and optionally ethane.

9. Method according to claim 1, wherein, before the expansion of step (e), the stream from the intermediate turbine is mixed with a supplementary stream of natural gas cooled by means of heat-exchange with the top stream of gas in a fourth heat-exchanger.

10. Method according to claim 1, wherein the content in terms of the top gas is such that the stream cooled by the second heat-exchanger is purely gaseous.

11. Installation for processing a stream of LNG obtained by means of cooling using a first refrigeration cycle, the installation comprising:

apparatus for sub-cooling the stream of LNG comprising a first heat-exchanger operable to bring the LNG stream into a heat-exchange relationship with a refrigerating fluid; and a second semi-open refrigeration cycle which is independent of the first refrigeration cycle, an intermediate turbine for dynamic expansion of the stream of sub-cooled LNG from the first heat-exchanger;

a device operable for cooling and expanding the stream from the intermediate turbine;

a distillation column which is connected to the cooling and expansion device;

a device operable for recovering a stream of denitrogenated LNG at the bottom of the column, and a device operable for recovering a stream of gas at the top of the column, a stage compressor which is connected to the device operable for recovering the stream of gas at the top of the column; and a device operable for extracting a first portion of the top stream of gas tapped at an intermediate pressure stage of the compressor in order to form a stream of combustible gas;

a second refrigeration cycle comprising:

a device operable for forming an initial stream of refrigerating fluid from a second portion of the top gas compressed to the intermediate pressure;

a device operable for compressing the initial stream of refrigerating fluid to a high pressure PH which is greater than the intermediate pressure PI in order to form a compressed stream of refrigerating fluid;

a second heat-exchanger operable to cool the compressed initial stream of refrigerating fluid;

a device operable for separating the compressed stream of refrigerating fluid from the second heat-exchanger into a main cooling stream and a sub-cooling stream of the LNG;

a third heat-exchanger for cooling the sub-cooling stream;

a device operable for introducing the sub-cooling stream from the third heat-exchanger into the first heat-exchanger;

a device operable for expanding the sub-cooling stream from the first heat-exchanger to a low pressure PB which is lower than the intermediate pressure PI in order to form a substantially liquid sub-cooling stream of the LNG;

a device operable for circulating the substantially liquid sub-cooling stream in the first heat-exchanger in order to form a reheated sub-cooling stream;

a main turbine operable for expanding the main cooling stream substantially to the low pressure PB;

a device operable for mixing the cooling stream from the main turbine with the sub-cooling stream which has been reheated in order to form a mixed stream;

a device operable for circulating the mixed stream successively in the third heat-exchanger then in the second heat-exchanger in order to form a reheated mixed stream;

a device operable for introducing the reheated mixed stream in the compressor at a low pressure stage which is located upstream of the intermediate pressure stage.

12. Installation according to claim 11, wherein the high pressure PH is between approximately 40 and 100 bar.

13. Installation according to claim 11, wherein the low pressure PB is lower than approximately 20 bar.

14. Installation according to claim 11, wherein the means for expanding the sub-cooling stream from the first heat-exchanger comprise a liquid expansion turbine.

15. Installation according to claim 11, wherein the means for compressing the initial stream of refrigerating fluid comprise an auxiliary compressor which is coupled to the main turbine.

16. Installation according to claim 11, wherein the second refrigeration cycle comprises means for introducing a stream of C2 hydrocarbons into the compressor in order to form a portion of the initial stream of refrigerating fluid.

17. Installation according to claim 11, wherein the second heat-exchanger comprises means for circulating a secondary refrigerating fluid, the installation comprising a third refrigeration cycle comprising secondary means for compressing the secondary refrigerating fluid from the third heat-exchanger, secondary means for cooling and expanding the secondary refrigerating fluid from the secondary compression means, and means for introducing the secondary refrigerating fluid from the secondary expansion means into the second heat-exchanger.

18. Installation according to claim 17, wherein the secondary refrigerating fluid comprises propane and optionally ethane.

19. Installation according to claim 11, wherein it comprises means for mixing the stream of sub-cooled LNG with a supplementary stream of natural gas, and a fourth heat-exchanger in order to bring the supplementary stream into a heat-exchange relationship with the top stream of gas.

20. Method according to claim 2, wherein the low pressure PB is lower than approximately 20 bar.

21. Installation according to claim 12, wherein the low pressure PB is lower than approximately 20 bar.

22. Method according to claim 1, wherein the high pressure PH is between approximately 60 and 75 bar.

23. Installation according to claim 11, wherein the high pressure PH is between approximately 60 and 75 bar.

* * * * *